US007162987B2

(12) United States Patent
Bourgault et al.

(10) Patent No.: US 7,162,987 B2
(45) Date of Patent: Jan. 16, 2007

(54) METHOD AND APPARATUS FOR MAINTAINING WARM ENGINE TEMPERATURE

(75) Inventors: Claude Bourgault, St. Brieux (CA); Larry Dancey, Melfort (CA)

(73) Assignee: Dryair Inc., St. Brieux (CA)

( * ) Notice: Subject to any disclaimer, the term of this patent is extended or adjusted under 35 U.S.C. 154(b) by 0 days.

(21) Appl. No.: 11/137,474

(22) Filed: May 26, 2005

(65) Prior Publication Data

US 2006/0042583 A1 Mar. 2, 2006

(30) Foreign Application Priority Data

Aug. 31, 2004 (CA) ..... 2479636

(51) Int. Cl.
*F02N 17/02* (2006.01)

(52) U.S. Cl. ..... 123/142.5 R; 237/8 R

(58) Field of Classification Search ..... 123/142.5 R; 237/8 R

See application file for complete search history.

(56) References Cited

U.S. PATENT DOCUMENTS 2,694,527 A * 11/1954 Russell et al. ..... 237/8 R
4,249,491 A 2/1981 Stein
4,711,204 A 12/1987 Rusconi
6,470,844 B1 10/2002 Biess

* cited by examiner

*Primary Examiner*—Noah P. Kamen
(74) *Attorney, Agent, or Firm*—Nixon & Vanderhye P.C.

(57) ABSTRACT

A portable apparatus for temporarily warming a plurality of vehicle engines includes a warm fluid circulation loop; an engine fluid circulation loop; a fluid heater; a fluid to fluid heat exchangers; a warm fluid pump; and an engine fluid pump. The warm fluid circulation loop connects the warm fluid heater to the fluid to fluid heat exchanger. The engine fluid circulation loop transfers engine fluid from engine fluid systems to the fluid to fluid heat exchanger. The fluid heater heats the fluid in the warm fluid circulation loop and the warm fluid is then circulated through the warm fluid circulation loop to the fluid to fluid heat exchanger to warm the engine fluid in the engine fluid circulation loop. The warmed engine fluid circulates through the engine fluid system warming the vehicle engine. The apparatus is configured to warm a plurality of vehicle engines at the same time.

14 Claims, 4 Drawing Sheets

METHOD AND APPARATUS FOR MAINTAINING WARM ENGINE TEMPERATURE

This invention is in the field of internal combustion engines, and in particular the operation of larger engines, such as locomotive engines, in cold weather.

BACKGROUND

When starting internal combustion engines in cold weather it is desirable to let the engine idle for a period of time in order to bring the engine up to a satisfactory operating temperature before putting it to work. In very cold weather, and with larger diesel engines such as those used in locomotives it can take a considerable period of time to reach operating temperature. It is also often very difficult to start a cold engine in some conditions, and once started considerable wear takes place before the engine oil warms up enough to provide satisfactory lubrication. For these reasons locomotive engines are often not shut down at all but left idling continuously emitting exhaust into the environment. Fuel costs for an idling locomotive engine are significant, and since the engine is running, unnecessary wear is taking place on engine parts.

This problem has been addressed in U.S. Pat. No. 4,711,204 to Rusconi and U.S. Pat. No. 6,470,844 to Beiss by providing a second smaller internal combustion engine that will warm and circulate coolant and lubricating oil, maintain charge in batteries, and so forth when the locomotive engine is shut down. Exhaust gas and coolant from the smaller engine, and inefficient pump operation, provide heat that is transferred to the oil and coolant through heat exchangers.

U.S. Pat. No. 4,249,491 to Stein discloses a system for heating and circulating both the oil and coolant in a locomotive engine. Both oil and coolant are circulated through a two-compartment tank. The coolant passes through an inner compartment of the tank where it is heated by contact with an electric element or some like heat source, and the oil passes through an outer compartment where it picks up heat from the heated coolant, but is protected from direct contact with the element.

The above systems are directed to heating a single vehicle engine. Vehicle engines require a great deal of energy to heat. Locomotive engines can have cooling systems with 900 liter capacities, which require the heating system to warm 900 liters of coolant. Modern engines also commonly come with aluminum pistons which can draw large amounts of heat out of the engine block. Because of the large amounts of heat required to keep a vehicle engine at a sufficient temperature, electric heating elements are often not powerful enough to sustain the engine at a sufficient level without specialized power supplies that can supply very large amounts of electricity. Stein discloses the limitation of heating systems in relation to keeping a vehicle engine warm and deals with it by heating both the coolant and oil system with the same electrical element. The prior art mention above is primarily concerned with attempting to keep one vehicle engine at a sufficient temperature and the apparatuses and methods disclosed are insufficient to heat multiple engines using a single heat source.

SUMMARY OF THE INVENTION

It is an object of the present invention to provide a method and apparatus for keeping a vehicle engine warm that overcomes problems in the prior art. It is a further object of the present invention to provide such an apparatus that is capable of keeping multiple vehicle engines warm at the same time by allowing engine fluid systems of a plurality of different vehicle engines to be connected to the apparatus at once.

It is a further object of the present invention to provide such an apparatus that is portable and can be moved from one location and set up at another location. It is a further object of the present invention to provide an apparatus that is portable and does not require any special power requirement allowing it to be moved to more locations and not have its portability limited by the apparatus requiring a particular power source.

It is a further object of the present invention to provide an apparatus with sufficient heat capacity so that only one engine fluid system in a vehicle engine must be heated or warmed by the apparatus. It is further object of the present invention to provide an apparatus that can vary its heat output to accommodate varying numbers of vehicle engines being connected to the apparatus at different times.

The present invention provides, in a first embodiment, an apparatus for temporarily warming a plurality of vehicle engines. The apparatus comprises: a warm fluid circulation loop; at least one engine fluid circulation loop connectable to at least one engine fluid system in a vehicle engine; a fluid heater operative to heat warm fluid in the warm fluid circulation loop; at least one fluid to fluid heat exchanger operatively connectable to the warm fluid circulation loop, operatively connectable to the engine fluid circulation loop and operative to transfer heat from warm fluid in the warm fluid circulation loop to engine fluid in the engine fluid circulation loop; at least one warm fluid pump operative to pump warm fluid through the warm fluid circulation loop and the at least one fluid to fluid heat exchanger; and at least one engine fluid pump operative to pump engine fluid through the engine fluid circulation loop and the engine fluid system and the at least one fluid to fluid heat exchanger. The apparatus is operatively connectable to engine fluid systems in a plurality of engines at the same time such that any vehicle can be released for travel independently of any other vehicle.

The present invention provides, in a second embodiment, a method of temporarily warming a plurality of vehicle engines. The method comprises heating fluid and circulating the warm fluid through at least one fluid to fluid heat exchanger; heating engine fluid from a first engine fluid system of a first vehicle engine by circulating the engine fluid through at least one fluid to fluid heat exchanger such that the engine fluid is heated by the warm fluid; heating engine fluid from a second engine fluid system of a second vehicle engine by circulating the engine fluid through at least one fluid to fluid heat exchanger such that the engine fluid is heated by the warm fluid; ceasing heating of engine fluid from the first engine fluid system, and releasing the first vehicle for travel while continuing to heat engine fluid from the second engine.

The present invention allows a single fluid heater to be connected to a number of vehicle engines so that the single fluid heater can keep all of the vehicle engines warm at the same time. The fluid heater heats a fluid in a warm fluid circulation loop and this warm fluid is circulated through the circulation loop and a fluid to fluid heat exchanger. This fluid to fluid heat exchanger then transfers the heat energy from the warm fluid circulation loop to an engine fluid circulation loop which is connected to an engine fluid system in a vehicle engine, thereby heating or warming the vehicle engine.

In one embodiment of the invention, a number of vehicle engines are connected to the apparatus by being connected in parallel to the warm circulation loop. In this embodiment the engine system of each vehicle is connected to its own engine fluid circulation loop and fluid to fluid heat exchanger. Each fluid to fluid heat exchanger is then connected to the warm fluid circulation loop in parallel with the other fluid to fluid heat exchangers. In this manner warm fluid in the warm fluid circulation loop circulates through all of the fluid to fluid heat exchangers which then heat their own engine fluid circulation loop and the vehicle engine attached to the engine fluid circulation loop.

In this embodiment of the invention, because each vehicle engine requires a separate engine fluid circulation loop and fluid to fluid heat exchanger, it may be desirable to fix the fluid to fluid heat exchanger to the vehicle. The fluid to fluid heat exchangers would then be releasably connectable to the warm fluid circulation loop. In this embodiment, the fluid to fluid heat exchanger and the engine fluid circulation loop would travel with the vehicle. When the vehicle is stopped and it is desired to keep the engine warm with the invention, the fluid to fluid heat exchanger would simply be connected to the warm fluid circulation loop.

In another embodiment, the invention consists of a fluid heater, a warm fluid circulation loop, one fluid to fluid heat exchanger and an engine fluid circulation loop. Each vehicle engine is then simply connected to the engine fluid circulation loop in parallel with the other engines. In this embodiment all of the engine fluids systems are connected together and the engine fluids of the different engines mix. This can complicate maintenance schedules and can prematurely foul the engine fluid of a vehicle engine by mixing it with a dirtier engine fluid from a different engine. Also, different engine fluid systems may have different resistances and this could cause some vehicles engines attached in parallel to the engine fluid circulation loop to get less warm engine fluid circulation through them and therefore will not be heated as much as other engines connected to the engine fluid circulation loop.

The present invention has the advantage of allowing one fluid heater to heat a number of different vehicle engines at the same time. This allows the present invention to be portable and moveable from one location to another location. In may be desirable to have the fluid heater comprise a burner heated by a carbon-based fuel, such as diesel or propane. This would allow the fluid heater to be moved to any location and be set up at that new location without requiring a special power source to be present at the new location. The use of a boiler or other high capacity fluid heater also can provide sufficient heat to keep a large engine at a satisfactorily high temperature compared to the prior art devices where maintaining satisfactory engine temperatures was problematic.

The fluid heater can comprise a fluid heater temperature controller that allows the fluid heater to maintain the fluid the warm fluid circulation loop at a substantially constant temperature even though the number of vehicle engines connected to the apparatus may vary over its operation. When an additional vehicle engine is connected to the apparatus, the fluid heater temperature controller could detect a corresponding drop in the temperature of the fluid in the warm fluid circulation loop and the fluid heater could adjust its output accordingly. Similarly, when a vehicle engine is disconnected from the apparatus, the fluid heater temperature controller could detect a corresponding increase in the temperature of the fluid in the warm fluid circulation loop and the fluid heater could decrease its output accordingly.

In a further embodiment, a lubricating oil pump is included. In this embodiment, the apparatus is connected to a vehicle engines cooling system and the cooling system and cooling fluid is used to keep the vehicle engine warm. The lubricating oil pump is connected to the vehicle engine lubricating oil system and the lubricating oil pump circulates the lubricating oil through the vehicle engine's lubricating oil system, lubricating the vehicle engine and keeping the lubricating oil warm by circulating it through the engine which has been warmed by warm coolant from the apparatus.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
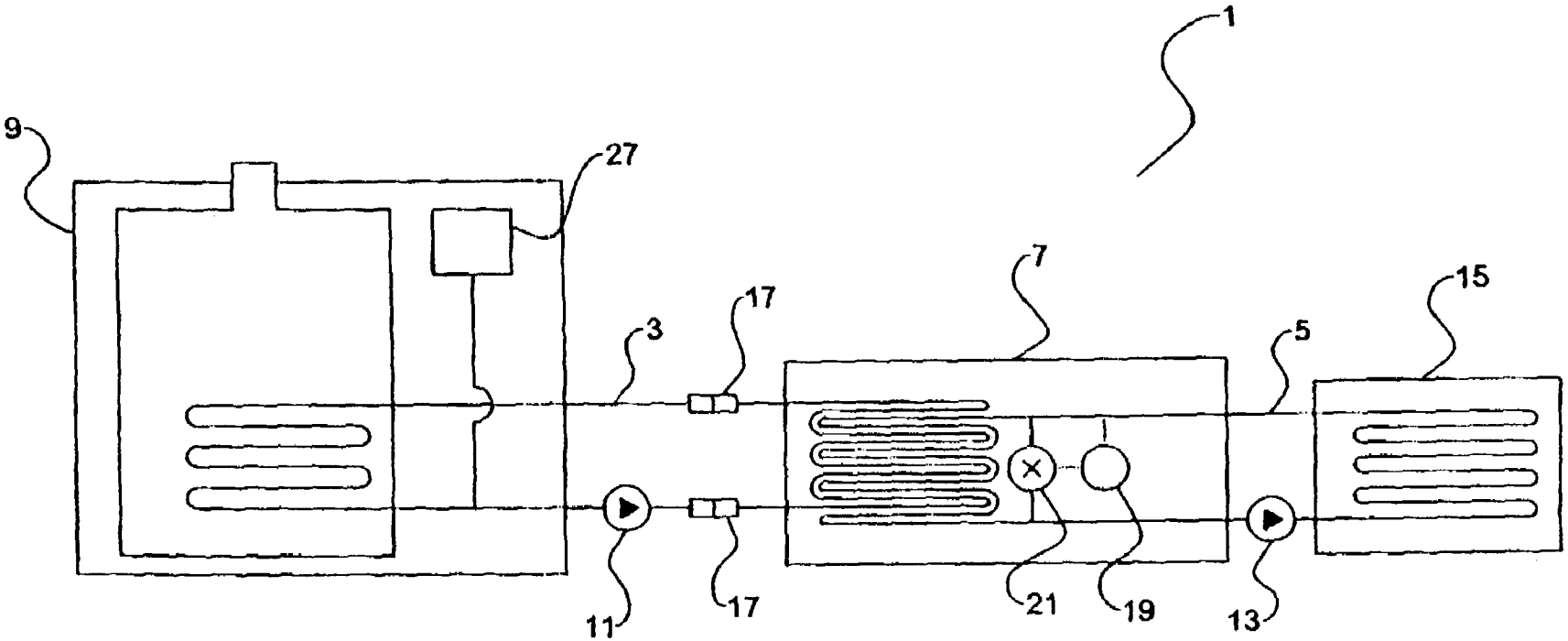
FIG. 1 is a schematic view of an embodiment of the invention.

FIG. 1 schematically illustrates an apparatus 1 for temporarily warming a plurality of vehicle engines. The apparatus 1 comprises: a warm fluid circulation loop 3; an engine fluid circulation loop 5; a fluid heater 9; a fluid to fluid heat exchanger 7; a warm fluid pump 11; and an engine fluid pump 13.

The warm fluid circulation loop 3 is piping suitable for containing and transferring a warm fluid through its piping. The warm fluid circulation loop 3 connects the fluid heater 9 to the fluid to fluid heat exchanger 7. The warm fluid circulation loop 3 contains fluid which is suitable for being heated by the fluid heater 9 and sufficient for storing and transferring the heat.

The engine fluid circulation loop 5 comprises piping suitable for containing engine fluid. The engine fluid circulation loop 5 is connectable to at least one engine fluid system 15 in a vehicle engine (not shown) and transfers engine fluid from the engine fluid system 15 out of the engine vehicle itself to the fluid to fluid heat exchanger 7. The connection of the engine fluid circulation loop 5 to the engine fluid system 15 can be done in any manner that is suitable so that there is an input for the engine fluid into the engine fluid system 15 and an output from the engine fluid system 15 after the engine fluid has circulated through the engine fluid system 15. These connections may be permanent so that the engine fluid circulation loop 5 is permanently connected to the engine fluid system 15 or that may take the form of a releasable connection that allows the engine fluid circulation loop 5 to be quickly and easily connected and disconnected from the engine fluid system 15.

This vehicle engine can be any type of vehicle engine from a small automobile to a larger industrial vehicle, however, the invention specifically contemplates that it would be particularly useful for a locomotive engine to be kept warm using the apparatus 1.

A typical vehicle engine will have two engine fluid systems 15 that are suitable for the present invention. These systems are the cooling system and the lubricating oil system. The invention contemplates that the engine fluid circulation loops 5 can be connected to an engine fluid system 15 which is a cooling system and the engine fluid would therefore be cooling fluid, or to an engine fluid system 15 which is a lubricating system and therefore the engine fluid would be a lubricating oil. It is also contemplated that both the cooling and lubricating systems could be connected to the heat exchanger 7.

The fluid heater 9 is connected to the warm fluid circulation loop 3. The warm fluid circulating through the warm fluid circulation loop 3 passes through the fluid heater 9 and is heated by the fluid heater 9.

The fluid heater 9 can comprise a fluid heater temperature controller 27, which monitors the temperature of the warm fluid in the warm fluid circulation loop 3 and will heat the warm fluid circulation loop 3 when it falls below a certain temperature. The fluid heater temperature controller 27 allows multiple vehicle engines to be hooked up to the apparatus 1 and the fluid heater 9 will compensate for the added vehicle engines by increasing its output. When only one vehicle engine is attached to the apparatus 1, the fluid heater 9 will only need to output a certain level of heat. When more vehicle engines are connected to the apparatus 1, the fluid heater 9 can increase its heat output to heat or warm the additional vehicle engines. As vehicle engines are disconnected from the apparatus 1, the fluid heater temperature controller 27 will compensate by decreasing its heat output in order to adjust to the number of vehicle engines remaining connected to the apparatus 1. Heat output will similarly depend on the ambient temperature, requiring a greater heat output in colder temperatures.

The fluid heater 9 could be relatively portable so that it can be moved to different locations and set up near the vehicle engines that will be kept warm. The apparatus 1 could then be moved to a location where the vehicles are and set up. In order for the fluid heater 9 to be more portable, it may be desirable for the fluid heater 9 to be releasable connected to the warm fluid circulation loop by releasable connections 17. However, it is not necessary because if the fluid to fluid heat exchanger 7 is compact enough, the fluid heater 9 can be permanently connected to the warm fluid circulation loop 3 and in turn the warm fluid circulation loop 3 can be permanently connected to the fluid to fluid heat exchanger 7. The fluid to fluid heat exchanger 7 could then be mounted to the outside of the fluid heater 9 making the fluid heater 7, warm fluid circulation loop 3 and fluid to fluid heat exchanger 7 essentially one piece of equipment.

Although any heating system known, which would be suitable for heating or warming the warm fluid in the warm fluid circulation loop 3 may be used (i.e. electrical elements, etc.), it is contemplated that the fluid heater 9 would typically take the form of a boiler such as one that is fueled by a carbon-based fuel such as petroleum fuel, diesel fuel or propane. This allows the fluid heater 9 to be more portable because it will not require a special power supply at each location, as in the case of an electric heating element which may require a special electrical supply, or as with a natural gas connection.

In some applications, such as vehicle storage locations, it may not be necessary for the fluid heater 9 to be portable. In these applications the fluid heater 9 could still take the form of a boiler system, but it is contemplated that the boiler system could be configured to be fueled by natural gas or electricity, and the fluid heater 9 could be permanently connected to a natural gas or electrical connection. A vehicle could be parked at the location and connected to the apparatus by quick-connect lines and then disconnected when the vehicle is ready to be moved.

The fluid to fluid heat exchanger 7 is any suitable fluid to fluid heat exchanger such as a plate heat exchanger and is operatively connectable to the warm fluid circulation loop 3 on its one side and operatively connected to the engine fluid circulation loop 5 on its other side. The warm fluid that circulates through the warm fluid circulation loop 3 is heated or warmed as it passes through the fluid heater 9. This heated or warmed warm fluid then circulates through the warm fluid circulation loop 3 and passes through the fluid to fluid heat exchanger 7. As the warm fluid passes through the fluid to fluid heat exchanger 7 the heated warm fluid is used to heat the engine fluid passing through the other side of the fluid to fluid heat exchanger 7. The warmed engine fluid in the other side of the fluid to fluid heat exchanger 7 circulates through the engine fluid circulation loop 5.

The fluid to fluid heat exchanger 7 may also comprise a temperature control that can control the temperature of the engine fluid in the engine fluid circulation loop. Typically, this temperature control would take the form of a temperature controller 19 and a bypass valve 21. The temperature controller 19 would monitor the temperature of the engine fluid in the engine fluid circulation loop 5 and could activate the bypass valve 21 in the event that the engine fluid becomes too warm. The bypass valve 21 would divert a portion of the engine fluid away from the fluid to fluid heat exchanger 7 controlling the temperature of the engine fluid in the engine fluid circulation loop 5.

A warm fluid pump 11 is used to pump the warm fluid through the warm fluid circulation loop 3. This warm fluid pump 11 pumps the warm fluid in the warm fluid circulation loop 3 through the warm fluid circulation loop 3 and circulates the warm fluid between the fluid heater 9 and the fluid to fluid heat exchanger 7.

An engine fluid pump 13 is used to pump the engine fluid through the engine fluid circulation loop 5. This engine fluid pump 13 pumps the engine fluid through the engine fluid loop 5, the fluid to fluid heat exchanger 7 and the engine fluid system 15.

Referring to FIG. 1, the apparatus 1 is used to heat a vehicle engine by positioning the vehicle containing the vehicle engine that is to be kept warm and the apparatus 1 in proximity to each other. The engine fluid circulation loop 5 is then connected to the engine fluid system 15 and the engine fluid pump 13 is activated. The fluid heater 9 can either already be running to keep the warm fluid in the warm fluid circulation loop 3 at a raised temperature, or it could be turned on at this point. The warm fluid passing through the fluid to fluid heat exchanger 7 will transfer heat to the engine fluid passing through the other side of the fluid to fluid heat exchanger 7. This heated or warmed engine fluid will then circulate through the engine fluid circulation loop 5 and through the engine system 15 pumped by the engine fluid pump 13, which can conveniently be a small electric pump that is plugged into an electrical outlet, or a generator if an outlet is not available. As the warmed or heated engine fluid circulates through the engine system 15, heat contained in the engine fluid will be transferred to the vehicle engine, keeping the vehicle engine warm.

Figure 2:
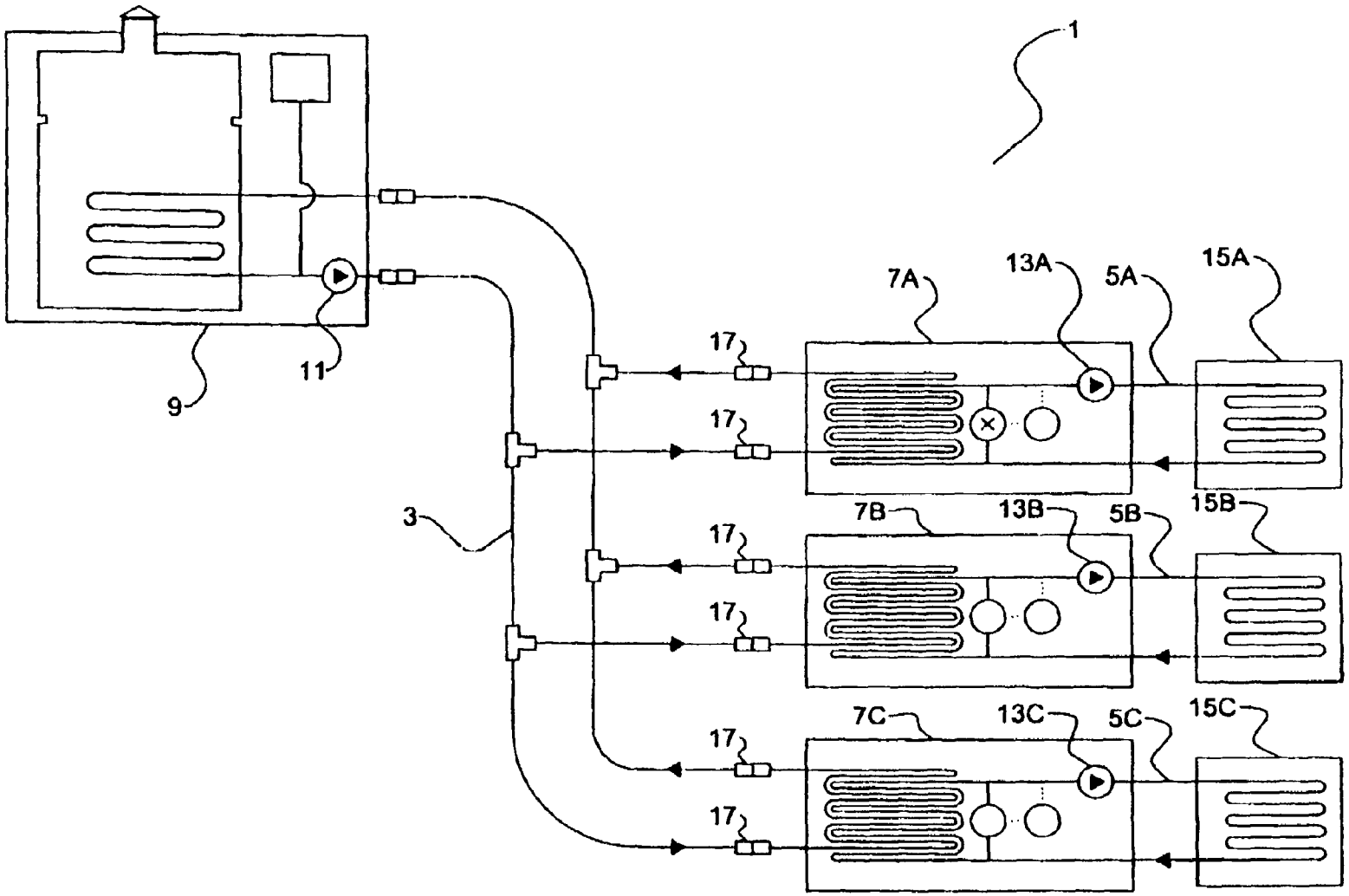
FIG. 2 is a schematic view of an embodiment of the invention with multiple vehicle engines connected.

FIG. 2 illustrates a different configuration of apparatus 1 configured to heat or warm multiple vehicle engines. In this configuration, apparatus 1 is connected to a first engine fluid system 15A in a first vehicle engine of a first vehicle, a second engine fluid system 15B in a second vehicle engine of a second vehicle, a third engine fluid system 15C in a third vehicle engine of a third vehicle and comprises: a warm fluid circulation loop 3; a first engine fluid circulation loop 5A; a second engine fluid circulation loop 5B; a third engine fluid circulation loop 5C; one fluid heater 9; a first fluid to fluid heat exchanger 7A; a second fluid to fluid exchanger 7B; a third fluid to fluid heat exchanger 7C; a warm fluid pump 11; a first engine fluid pump 13A; a second engine fluid pump 13B; and a third engine fluid pump 13C.

The first fluid to fluid heat exchanger 7A, the second fluid to fluid heat exchanger 7B and the third fluid to fluid heat exchanger 7C are connected to the warm fluid circulation loop 4 in parallel so that any fluid to fluid heat exchanger can be disconnected without disconnecting any other.

The warm fluid heater 9 is connected to the warm fluid circulation loop 4. The first, second, and third fluid to fluid heat exchangers 7A, 7B, 7C are connected to the warm fluid circulation loop 3 by a releasable connection 17. The warm fluid in the warm fluid circulation loop 3 will be passed through the warm fluid heater 9 and heated or warmed. The heated or warmed warm fluid will then be circulated by the warm fluid pump 11 through the warm fluid circulation loop 3. Because the first fluid to fluid heat exchanger 7A, the second fluid to fluid heat exchanger 7B and the third fluid to fluid heat exchanger 7C are connected to the warm fluid circulation loop 3 in parallel, the warm fluid will pass through the first fluid to fluid heat exchanger 7A, the second fluid to fluid heat exchanger 7B and the third fluid to fluid heat exchanger 7C.

The first fluid to fluid heat exchanger 7A is attached to a first engine fluid circulation loop 5A which is attached to a first engine fluid system 15A in a first vehicle engine. The first fluid to fluid heat exchanger 7A will transfer heat from warm fluid from the warm fluid circulation loop 3 to engine fluid from the first engine fluid circulation loop 5A. The first engine fluid pump 13A will circulate the heated or warmed engine fluid through the first engine fluid circulation loop 5A from the first fluid to fluid heat exchanger 7A through the first engine fluid circulation loop 5A and circulate the heated or warmed engine fluid through the first engine fluid system 15A heating or warming the first vehicle engine.

The second fluid to fluid heat exchanger 7B is attached to a second engine fluid circulation loop 5B which is attached to a second engine fluid system 15B in the second engine. The second fluid to fluid heat exchanger 7B will transfer heat from warm fluid from the warm fluid circulation loop 3 to engine fluid from the second engine fluid circulation loop 5B. The second engine fluid pump 11B will circulate the heated or warmed engine fluid through the second engine fluid circulation loop 5B from the second fluid to fluid heat exchanger 7B through the second engine fluid circulation loop 5B and circulate the heated or warmed engine fluid through the second engine fluid system 15B heating or warming the second vehicle engine. Similarly with the third fluid to fluid heat exchanger 7C.

When apparatus 1 is configured as illustrated in FIG. 2 and there is a first vehicle engine already connected to the apparatus 1, a second vehicle engine can easily be additionally connected. The second engine fluid system 15B is simply connected to the second engine circulation loop 5B which is in turn connected to the second fluid to fluid heat exchanger 7B. This second fluid to fluid heat exchanger 7B is then connected in parallel to the warm fluid circulation loop 3. In this manner additional vehicle engines can be added to apparatus 1 in the above manner. The limiting factor to the number of vehicle engines that can be warmed at one time is the capacity of the fluid heater 9 and the ambient conditions.

In the configuration of apparatus 1 as illustrated in FIG. 2, it is contemplated that it may be desirable for the first fluid to fluid heat exchanger 7A and the second fluid heat exchanger 7B to be mounted to the first vehicle and second vehicle respectively. The warm fluid circulation loop 3 would be releasably connectable to the first fluid to fluid heat exchanger 7A and the second fluid to fluid heat exchanger 7B. The first fluid to fluid heat exchanger 7A or second fluid to fluid heat exchanger 7B could be mounted such that it is on the outside of the vehicle or it could be mounted inside the engine compartment of the vehicle with releasable connections 17 accessible from the outside.

Although the apparatus 1 of FIG. 2 shows three engine fluid systems connected to the apparatus 1, more engine fluid systems could be connected. The number of engine fluid systems that can be connected to the apparatus 1 will depend upon the outside temperature and the capacity of the fluid heater 9.

Figure 3:
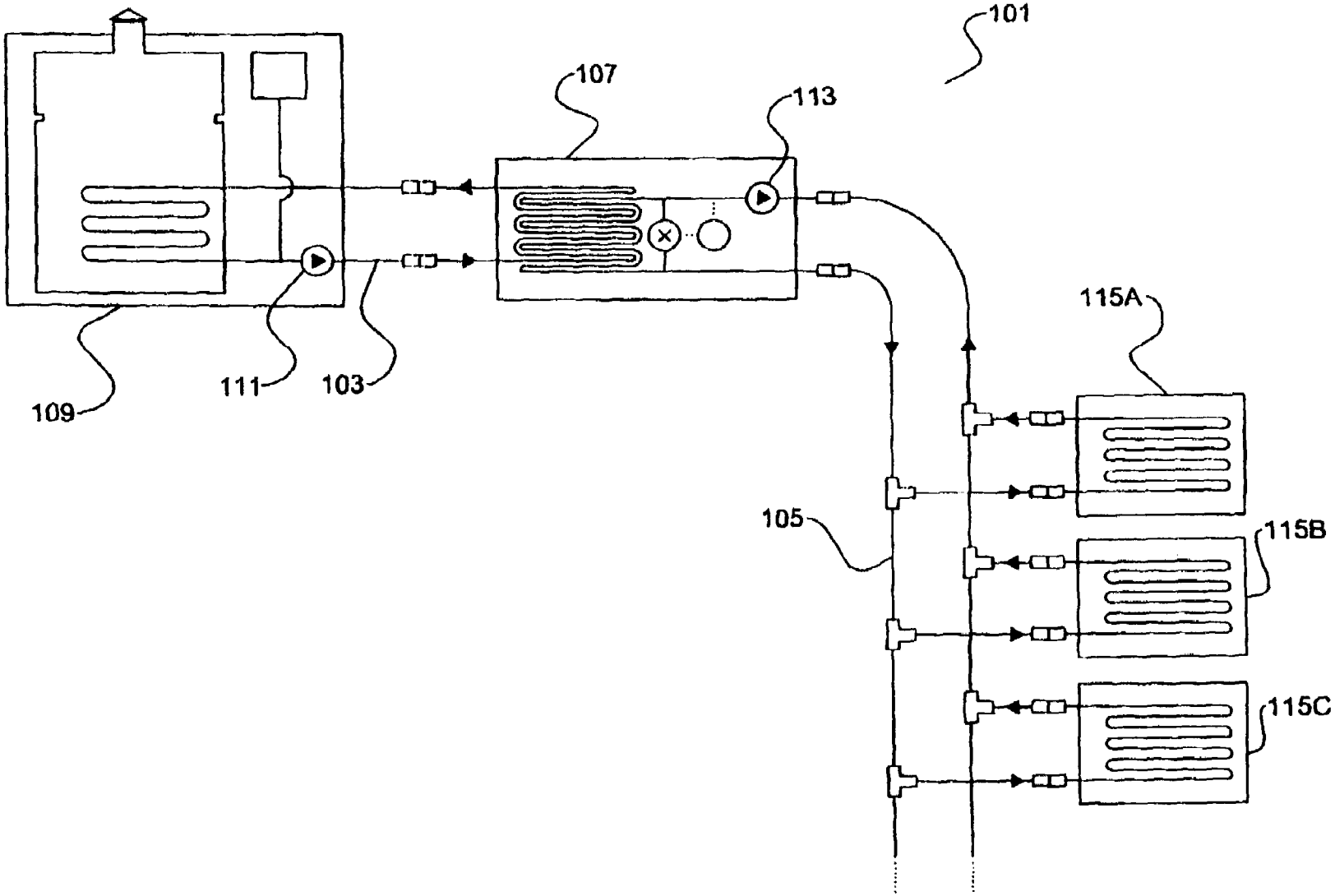
FIG. 3 is a schematic view of an alternate embodiment of the invention with multiple vehicle engines connected in parallel.

FIG. 3 illustrates an alternate embodiment the invention showing apparatus 101 in a different configuration to heat or warm multiple vehicle engines. In this configuration apparatus 101 is connected to a first engine fluid system 115A, a second engine fluid system 115B and a third engine fluid system 115C in parallel and comprises: a warm fluid circulation loop 103; an engine fluid circulation loop 105; one fluid heater 109; one first fluid to fluid heat exchanger 107; a warm fluid pump 111; and an engine fluid pump 113.

Apparatus 101 is connected to the first engine fluid system 115A in a first vehicle engine of a first vehicle, the second engine fluid system 115B in a second vehicle engine of a second vehicle and the third engine fluid system 115C in a third vehicle engine of a third vehicle. The warm fluid circulation loop 103 circulates warm fluid between the fluid heater 109 which warms or heats the warm fluid and the fluid to fluid heat exchanger 107. The fluid to fluid heat exchanger 107 is releasably connected to the engine fluid circulation loop 105 and the engine fluid pump 113 circulates engine fluid which has been warmed or heated by the fluid to fluid heat exchanger 107 from the fluid to fluid heat exchanger 107 through the engine fluid circulation loop 105. The first engine fluid system 115A, the second engine fluid system 115B and the third engine fluid system 115C are attached in parallel to the engine fluid circulation loop 105 and the pressure of the engine fluid created by the engine fluid pump 113 in the engine fluid loop 105 circulates heated or warmed engine fluid through the first engine fluid system 115A, the second engine fluid system 115B and the third engine fluid system 115C heating for warming the first vehicle engine, second vehicle engine and the third vehicle engine, respectively.

When the apparatus 101 is configured as illustrated in FIG. 3 and there is a first vehicle engine already connected to the apparatus 101, a second vehicle engine can easily be additionally connected. The second engine fluid system 115B is simply connected to the engine circulation loop 105 in parallel with the first engine fluid system 115A. In this manner additional vehicle engines can be added to apparatus 101 by connected the new vehicle system in parallel to the engine fluid circulation loop 105. The limiting factor to the number of vehicle engines that can be warmed at one time is the capacity of the fluid heater 109 and the ambient conditions.

In FIG. 3 a number of engine fluid systems are connected to the engine fluid circulation loop 105 in parallel. Because the engine fluid systems are connected in parallel, the engine fluid of the first engine fluid system 115A, second engine fluid system 115B and third engine fluid system 15C are all mixed together in the engine fluid circulation loop 105. Variations in the different engine fluid systems may result in different flow rates in the different engine fluid systems, and as a result all engine fluid systems may not be warmed to the same temperature. It may therefore be desirable in most situations to use an alternate embodiment, such as that illustrated in FIG. 2.

Figure 4:
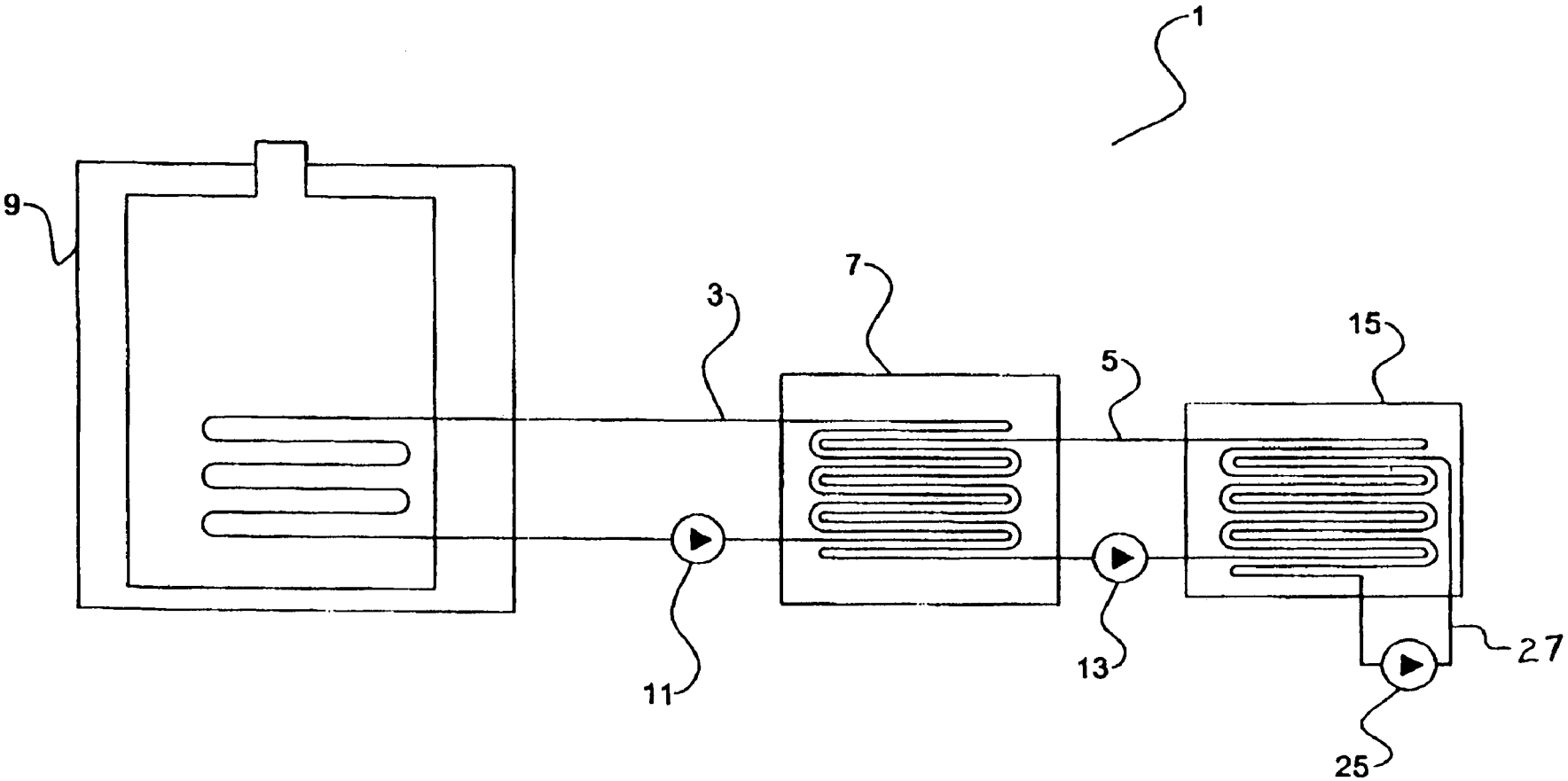
FIG. 4 is a schematic view of an embodiment of the invention wherein the engine fluid circulated through the heat exchanger is coolant, and further comprising a lubricating oil pump.

FIG. 4 schematically illustrates the embodiment of FIG. 1 in an application where the engine fluid being warmed is coolant and further comprising a lubricating oil pump 25 to circulate the lubricating oil in the vehicle engine through the lubricating oil system. In some applications, such as with large locomotive engines, it may be desirable to circulate the lubrication oil through the lubricating oil system of the vehicle engine in order to keep the lubricating oil warm as well. The apparatus 1 would be configured as described in relation to FIG. 1 where the engine fluid is cooling fluid and the engine fluid system is the cooling system, however, it also comprises the lubricating oil pump 25. The apparatus 1 would heat or warm the vehicle engine as above by circulating the cooling fluid through the engine fluid system 15 being the coolant system, the engine fluid circulation loop 5 and the fluid to fluid heat exchanger 7. The lubricating oil pump 25 is connected to the lubricating oil system 27 of the vehicle engine and circulates the lubricating oil through the vehicle engine. The cooling system and lubricating oil system both comprise conduits running through the engine block, as schematically indicated in FIG. 4 where the cooling system and lubricating oil system are indicated by adjacent conduits. Heating of the lubricating oil is thus simply accomplished indirectly with the engine block acting as a heat exchanger to transfer heat from the warmed cooling fluid circulating in the coolant system to the lubricating oil circulating in the lubricating oil system.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

We claim:

1. An engine and engine warming apparatus comprising:
a warm fluid circulation loop;
a fluid heater operative to heat warm fluid in the warm fluid circulation loop;
a first fluid to fluid heat exchanger mounted to a first vehicle and releasably connectable to the warm fluid circulation loop and operably connected to a first engine fluid circulation loop which is operatively connected to a first engine fluid system in a first vehicle engine in the first vehicle, and a first engine fluid pump operative to pump engine fluid through the first engine fluid circulation loop and the first engine fluid system and the first fluid to fluid heat exchanger;
a second fluid to fluid heat exchanger mounted to a second vehicle and releasably connectable to the warm fluid circulation loop and operably connected to a second engine fluid circulation loop which is operatively connected to a second engine fluid system in a second vehicle engine in the second vehicle, and a second engine fluid pump operative to pump engine fluid though the second engine fluid circulation loop and the second engine fluid system and the second fluid to fluid heat exchanger;
at least one warm fluid pump operative to pump warm fluid through the warm fluid circulation loop and the fluid to fluid heat exchangers; and
wherein the fluid to fluid heat exchangers are operative to transfer heat from warm fluid in the warm fluid circulation loop to engine fluid in the engine fluid circulation loops.

2. The apparatus of claim 1 wherein the first fluid to fluid heat exchanger is mounted to the vehicle externally.

3. The apparatus of claim 1 wherein the first fluid to fluid heat exchanger is mounted to the first vehicle internally.

4. The apparatus of claim 1 wherein the warm fluid circulation loop is connectable in parallel to a plurality of fluid to fluid heat exchangers.

5. The apparatus of claim 1 wherein the fluid heater is portable.

6. The apparatus of claim 1 wherein the fluid heater comprises a boiler.

7. The apparatus of claim 6 wherein the boiler is fueled by carbon-based fuel.

8. The apparatus of claim 1 wherein the fluid heater is releasably connected to the warm circulation loop.

9. An apparatus adapted for temporarily warming a plurality of vehicle engines, the apparatus comprising:
a warm fluid circulation loop;
at least one engine fluid circulation loop connectable to at least one engine fluid system in a vehicle engine;
a fluid heater operative to heat warm fluid in the warm fluid circulation loop;
at least one fluid to fluid heat exchanger operatively connectable to the warm fluid circulation loop, operatively connectable to the engine fluid circulation loop and operative to transfer heat from warm fluid in the warm fluid circulation loop to engine fluid in the engine fluid circulation loop;
a temperature control operative to control a temperature of engine fluid in the engine fluid circulation loop;
at least one warm fluid pump operative to pump warm fluid through the warm fluid circulation loop and the at least one fluid to fluid heat exchanger; and
at least one engine fluid pump operative to pump engine fluid through the engine fluid circulation loop and the engine fluid system and the at least one fluid to fluid heat exchanger;
wherein the apparatus is operatively connectable to engine fluid systems in a plurality of engines at the same time such that any vehicle can be released for travel independently of any other vehicle;
wherein the temperature control comprises a bypass valve operative to divert a portion of the engine fluid in the engine fluid circulation loop away from the fluid to fluid heat exchanger and a temperature controller operative to open and close the bypass valve in response to the temperature of the engine fluid in the engine fluid circulation loop.

10. An apparatus adapted for temporarily warming a plurality of vehicle engines, the apparatus comprising:

a warm fluid circulation loop;

at least one engine cooling fluid circulation loop connectable to at least one engine cooling fluid system in a vehicle engine;

a fluid heater operative to heat warm fluid in the warm fluid circulation loop;

at least one fluid to fluid heat exchanger operatively connectable to the warm fluid circulation loop, operatively connectable to the engine fluid circulation loop and operative to transfer heat from warm fluid in the warm fluid circulation loop to engine fluid in the engine fluid circulation loop;

at least one warm fluid pump operative to pump warm fluid through the warm fluid circulation loop and the at least one fluid to fluid heat exchanger; and at least one engine fluid pump operative to pump engine fluid through the engine fluid circulation loop and the engine fluid system and the at least one fluid to fluid heat exchanger;

a lubricating oil pump operative to circulate lubricating oil in a vehicle engine lubricating system such that the vehicle engine is kept lubricated while the vehicle engine is not running, and wherein the lubricating oil is warmed by the cooling fluid circulating through the cooling system;

wherein the apparatus is operatively connectable to engine fluid systems in a plurality of engines at the same time such that any vehicle can be released for travel independently of any other vehicle.

11. An apparatus adapted for temporarily warming a plurality of vehicle engines, the apparatus comprising:

a warm fluid circulation loop:

at least one engine fluid circulation loop connectable to at least one engine lubricating system in a vehicle engine;

a fluid heater operative to heat warm fluid in the warm fluid circulation loop;

at least one fluid to fluid heat exchanger operatively connectable to the warm fluid circulation loop, operatively connectable to the engine fluid circulation loop and operative to transfer heat from warm fluid in the warm fluid circulation loop to engine lubricating oil in the engine fluid circulation loop;

at least one warm fluid pump operative to pump warm fluid through the warm fluid circulation loop and the at least one fluid to fluid heat exchanger; and at least one engine fluid pump operative to pump engine lubricating oil through the engine fluid circulation loop and the engine lubricating system and the at least one fluid to fluid heat exchanger;

wherein the apparatus is operatively connectable to engine fluid systems in a plurality of engines at the same time such that any vehicle can be released for travel independently of any other vehicle.

12. A method of temporarily warming a plurality of vehicle engines, the method comprising:

heating fluid and circulating the warm fluid through first and second fluid to fluid heat exchangers attached to respective first and second vehicles;

circulating engine fluid from a first engine fluid system through the first fluid to fluid heat exchanger and circulating engine fluid from a second engine fluid system through the second fluid to fluid heat exchanger such that engine fluid in the first and second engine fluid systems is heated by the warm fluid;

ceasing heating of engine fluid from the first engine fluid system, and releasing the first vehicle for travel while continuing to heat engine fluid from the second engine; and releasing the first vehicle for travel by disconnecting the warm circulation loop from the first fluid to fluid heat exchanger.

13. The method of claim 12 comprising releasing the second vehicle for travel by disconnecting the warm fluid circulation loop from the second fluid to fluid heat exchanger.

14. A method of temporarily warming a plurality of vehicle engines, the method comprising:

heating fluid and circulating the warm fluid through at least one fluid to fluid heat exchanger;

heating engine coolant fluid from a first engine cooling fluid system of a first vehicle engine by circulating the engine fluid through the at least one fluid to fluid heat exchanger such that the engine coolant fluid is heated by the warm fluid;

circulating lubricating oil from the first vehicle engine through a lubricating oil system of the first vehicle engine while the engine coolant of the first vehicle engine is being heated by the warm fluid;

heating engine fluid from a second engine fluid system of a second vehicle engine by circulating the engine fluid through the at least one fluid to fluid heat exchanger such that the engine fluid is heated by the warm fluid;

ceasing heating of engine fluid from the first engine fluid system, and releasing the first vehicle for travel while continuing to heat engine fluid from the second engine.

* * * * *